US012233453B2

(12) United States Patent
Wang

(10) Patent No.: US 12,233,453 B2
(45) Date of Patent: Feb. 25, 2025

(54) HAND RIVETER

(71) Applicants: HANGZHOU UNITED TOOLS CO., LTD., Hangzhou (CN); HANGZHOU GREAT STAR INDUSTRIAL CO., LTD., Hangzhou (CN)

(72) Inventor: Weiyi Wang, Hangzhou (CN)

(73) Assignees: HANGZHOU UNITED TOOLS CO., LTD., Hangzhou (CN); HANGZHOU GREAT STAR INDUSTRIAL CO., LTD., Hangzhou (CN)

( * ) Notice: Subject to any disclaimer, the term of this patent is extended or adjusted under 35 U.S.C. 154(b) by 90 days.

(21) Appl. No.: 17/604,695

(22) PCT Filed: Apr. 19, 2019

(86) PCT No.: PCT/CN2019/083369

§ 371 (c)(1),
(2) Date: Oct. 18, 2021

(87) PCT Pub. No.: WO2020/211068

PCT Pub. Date: Oct. 22, 2020

(65) Prior Publication Data

US 2022/0203431 A1 Jun. 30, 2022

(51) Int. Cl.
*B21J 15/38* (2006.01)
*B21J 15/04* (2006.01)

(52) U.S. Cl.
CPC ..... *B21J 15/386* (2013.01); *B21J 15/043* (2013.01); *B21J 15/383* (2013.01)

(58) Field of Classification Search
CPC ..... B21J 15/38; B21J 15/383; B21J 15/386; Y10T 29/53757
See application file for complete search history.

(56) References Cited

U.S. PATENT DOCUMENTS 2,400,354 A * 5/1946 Jensen ..... B21J 15/386 29/243.526
3,561,249 A * 2/1971 Freeman ..... B21J 15/386 29/283.5

(Continued)

FOREIGN PATENT DOCUMENTS

CN 1221667 A 7/1999
CN 1743098 A 3/2006

(Continued)

OTHER PUBLICATIONS

PCT; App No. PCT/CN2019/083369; International Search Report and Written Opinion mailed Jan. 21, 2020.

*Primary Examiner* — Jared O Brown
(74) *Attorney, Agent, or Firm* — FITCH EVEN TABIN & FLANNERY, LLP

(57) ABSTRACT

The present invention discloses a hand riveter and relates to the field of hand-operated tools, and the hand riveter comprises a first handle, a second handle and a clamping and pulling mechanism, wherein the second handle is capable of rotating around a pivoting shaft with respect to the first handle; the second handle is separated into a force applying end and a warping end by the pivoting shaft, and the warping end and the clamping and pulling mechanism are connected via a connecting shaft; when the force applying end of the second handle is rotated and opened with respect to the first handle, the warping end of the second handle drives the clamping and pulling mechanism to move in a rivet-driving direction; and when the force applying end of the second handle is rotated and closed with respect to the first handle, the warping end of the second handle drives the clamping and pulling mechanism to move in a rivet-pulling direction.

(Continued)

According to rational arrangements of the present invention, the hand riveter is labor-saving and is comfortable to hold during pull riveting.

8 Claims, 5 Drawing Sheets

(56) References Cited

U.S. PATENT DOCUMENTS

| | | | | |
|---|---|---|---|---|
| 4,192,163 | A | 3/1980 | Martin | |
| 4,648,259 | A * | 3/1987 | Pendleton | B21J 15/386 29/243.521 |
| 5,361,474 | A | 11/1994 | Yang | |
| 6,115,900 | A | 9/2000 | Cerulo et al. | |
| 6,588,246 | B2 * | 7/2003 | Ko | B21J 15/043 72/477 |
| 8,776,338 | B2 | 7/2014 | Yuan | |
| 2014/0137379 | A1 * | 5/2014 | Yuan | B21J 15/386 29/243.521 |
| 2017/0338614 | A1 * | 11/2017 | Sutter | H01R 43/015 |

FOREIGN PATENT DOCUMENTS

| | | | | | |
|---|---|---|---|---|---|
| CN | 102476158 | A | | 5/2012 | |
| CN | 204381276 | U | | 6/2015 | |
| CN | 109365713 | A | * | 2/2019 | B21J 15/38 |
| CN | 209953733 | U | | 1/2020 | |
| CN | 111872310 | A | * | 11/2020 | B21J 15/38 |
| EP | 1262259 | A1 | * | 12/2002 | B21J 15/386 |
| NL | 7408634 | A | | 12/1975 | |

* cited by examiner

HAND RIVETER

FIELD OF THE INVENTION

The present invention relates to the field of hand-operated tools, and in particular to a hand riveter.

DESCRIPTION OF THE PRIOR ART

A traditional hand riveter comprises handles and a clamping and pulling mechanism. When in use, the handles are closed and the clamping and pulling mechanism is pulled up, and the clamping and pulling mechanism clamps and pulls a rivet apart. Most hand riveters are based on the principle of leverage. In order to achieve a greater lever ratio and save labor, a warping end is closer to a support axis, that is, the closer the hole distance is, the more the effort is saved, but it will also make the pull riveting stroke shorter and the number of times of pulling increased. When the stroke is reduced to a certain distance, a normal pull riveting function will be lost, and a handle opening being too large causes clamping uncomfortable.

Therefore, those skilled in the art are committed to developing a hand riveter, which is more labor-saving and more comfortable to operate; and meanwhile, through the design of a specification head, one specification head can be used for many purposes.

SUMMARY OF THE INVENTION

In view of the above-mentioned drawbacks of the prior art, the technical problem to be solved by the present invention is to provide a hand riveter which is more labor-saving during pull riveting and is free from specification head changing.

To achieve the above object, the present invention provides a hand riveter, which comprises a first handle, a second handle and a clamping and pulling mechanism, wherein the second handle is capable of rotating around a pivoting shaft with respect to the first handle;

the second handle is separated into a force applying end and a warping end by the pivoting shaft, and the warping end and the clamping and pulling mechanism are connected via a connecting shaft; when the force applying end of the second handle is rotated and opened with respect to the first handle, the warping end of the second handle drives the clamping and pulling mechanism to move in a rivet-driving direction; when the force applying end of the second handle is rotated and closed with respect to the first handle, the warping end of the second handle drives the clamping and pulling mechanism to move in a rivet-pulling direction; and a relative position between the connecting shaft and the pivoting shaft is provided as:

a first force bearing point is located at an axis of the connecting shaft, a second force bearing point is located on the second handle, and when the first handle and the second handle are closed, a largest grip distance position exists, and the ratio of the distance between the first force bearing point and the axis of the pivoting shaft to the distance between the second force bearing point and the axis of the pivoting shaft is 1:16-1:25; or the distance between the axis of the connecting shaft and the axis of the pivoting shaft is 8-12 mm.

Further, wherein the clamping and pulling mechanism comprises a pulling sleeve, and the pulling sleeve is connected to the warping end via the connecting shaft and drives the clamping and pulling mechanism to move; and at the position where the pulling sleeve is spatially closest to the pivoting shaft, at least one of the pulling sleeve or the pivoting shaft is provided with a space avoidance groove.

Further, wherein the position at which the force applying end of the second handle is maximally rotated and opened with respect to the first handle is a first position, the position at which the force applying end of the second handle is maximally closed with respect to the first handle is a second position, and the angle that the second handle rotates from the first position, with respect to the first handle, to the second position is 20°-60°.

Further, wherein the position at which the force applying end of the second handle is maximumly rotated and opened with respect to the first handle is the first position, the position at which the force applying end of the second handle is maximally closed with respect to the first handle is the second position, the line penetrating through the axis of the pivoting shaft and being perpendicular to a moving direction of the clamping and pulling mechanism is an auxiliary line, and the auxiliary line is in the same plane as the first handle, the second handle and the axis of the pivoting shaft; and the angle between the warping end of the second handle at the first position and the auxiliary line is a first angle, the angle between the warping end of the second handle at the second position and the auxiliary line is a second angle, and the first angle and the second angle are on two sides of the auxiliary line.

Further, wherein the first angle is 10°-30°, and the second angle is 10°-30°.

Further, wherein the first angle is 22°, and the second angle is 22°.

Further, wherein the first angle is equal to the second angle.

Further, wherein the material of the pivoting shaft is one of 35 steel, 45 steel or 40Cr.

The present invention further provides a further hand riveter, which comprises a first handle, a second handle and a clamping and pulling mechanism, wherein the second handle is capable of rotating around a pivoting shaft with respect to the first handle;

the second handle is separated into a force applying end and a warping end by the pivoting shaft, and the warping end and the clamping and pulling mechanism are connected via a connecting shaft; when the force applying end of the second handle is rotated and opened with respect to the first handle, the warping end of the second handle drives the clamping and pulling mechanism to move in a rivet-driving direction; when the force applying end of the second handle is rotated and closed with respect to the first handle, the warping end of the second handle drives the clamping and pulling mechanism to move in a rivet-pulling direction; and the clamping and pulling mechanism comprises a spring, a hollow ejector rod, a separate jaw and a pulling sleeve, wherein the spring, the hollow ejector rod and the separate jaw are sequentially provided in the pulling sleeve from top to bottom; inclined faces cooperating with each other are provided on the jaw and the pulling sleeve, and the spring elastically presses the separate jaw onto the inclined faces cooperating with each other via the hollow ejector rod; and the hand riveter further comprises a specification head used for separating the jaw, wherein an end face of the specification head is provided with a groove, the depth of the groove is no more than 2 mm, and the width of the groove is no less than 5 mm.

Further, wherein the groove is one of a circular arc groove, a step-shaped groove or a chamfering groove.

The beneficial technical effects of the present invention are as follows: on the premise of guaranteeing normal function and comfortable use, a rational distance between the warping end and a support axis is selected so that pull riveting is more labor-saving; and meanwhile, the groove is provided on the end face of the specification head to adapt to pull riveting needs of rivets of various specifications, so that the hand riveter does not need to change the specification head when pulling the rivets of various specifications.

The concept, specific structure and resulting technical effect of the present invention are further described below in conjunction with the drawings to fully understand the object, features and effects of the present invention.

DETAILED DESCRIPTION OF THE PREFERRED EMBODIMENTS

Figure 1:
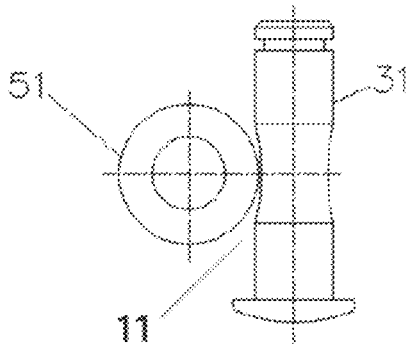
FIG. 1 is a schematic view of a space avoidance groove used by a pivoting shaft of a preferred embodiment of the present invention.

Preferred embodiments of the present invention are described below with reference to the drawings of the description to make the technical contents clearer and easier to understand. The present invention can be embodied in various forms of embodiments, and the scope of protection of the present invention is not limited to the embodiments mentioned herein.

In the drawings, the same reference numeral indicates components having the same structure, and similar reference numerals indicate assemblies having similar structures or functions throughout. The size and thickness of each assembly shown in the figures are shown arbitrarily, and the present invention does not define the size and thickness of each assembly. In order to make the illustration clearer, the thickness of the component in some places of the figures is appropriately exaggerated.

Figure 5:
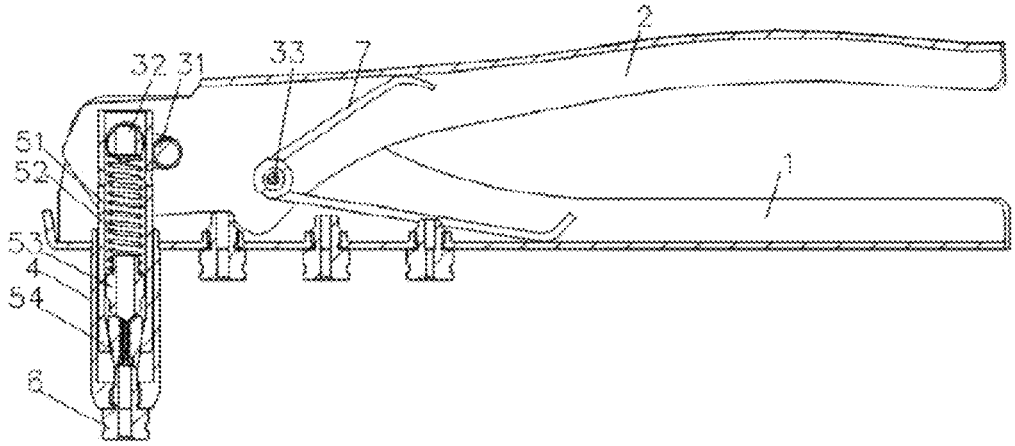
FIG. 5 shows a hand riveter of a preferred embodiment of the present invention.

As shown in FIG. 5, a hand riveter of a specific embodiment of the present invention comprises a first handle 1, a second handle 2, and a clamping and pulling mechanism, wherein the first handle 1 is fixedly connected to, or integral with a shell 4 defining the clamping and pulling mechanism, and the second handle 2 is capable of rotating around a pivoting shaft 31 with respect to the first handle 1.

The present invention is a device based on the principle of lever warping, wherein the pivoting shaft 31 is the fulcrum of a lever, the second handle 2 is separated into a force applying end and a warping end by the pivoting shaft 31, and the warping end and the clamping and pulling mechanism are connected via a connecting shaft 32; when the force applying end of the second handle 2 is rotated and opened with respect to the first handle 1, the warping end of the second handle 2 drives the clamping and pulling mechanism to move in a rivet-driving direction; and when the force applying end of the second handle 2 is rotated and closed with respect to the first handle 1, the warping end of the second handle 2 drives the clamping and pulling mechanism to move in a rivet-pulling direction. Wherein a first force bearing point is located at the axis of the connecting shaft 32, a second force bearing point is located on the second handle 2, and when the first handle 1 and the second handle 2 are closed, the largest grip distance position exists. It should be noted that, the rivet-driving direction is a downward direction as shown in FIG. 5, and the rivet-pulling direction is an upward direction as shown in FIG. 5.

In order to achieve a greater lever ratio and save labor, the shorter the distance between the warping end and the axis of the pivoting shaft 31 is, the more the effort is saved, but it will also make the pull riveting stroke shorter and the number of times of pull riveting increased. When the stroke is reduced to a certain distance, a normal pull riveting function will be lost, and in order to increase the pull riveting stroke, an opening between the first handle 1 and the second handle 2 being too large causes clamping uncomfortable; and meanwhile, the longer the distance between the force applying end and the axis of the pivoting shaft 31 is, the more the effort is saved, but it will also make the hand riveter larger and cause inconvenient operation. In order to save labor and increase clamping comfort at the same time, in some embodiments, optimally, the ratio of the distance between the first force bearing point and the axis of the pivoting shaft 31 to the distance between the second force bearing point and the axis of the pivoting shaft 31 is 1:16-1:25. While in some other embodiments, the distance between the axis of the connecting shaft 32 and the axis of the pivoting shaft 31 is defined to be 8-12 mm. In a further embodiment, it is necessary to simultaneously satisfy the following conditions: the ratio of the distance between the first force bearing point and the axis of the pivoting shaft 31 to the distance between the second force bearing point and the axis of the pivoting shaft 31 is 1:16-1:25, and the distance between the axis of the connecting shaft 32 and the axis of the pivoting shaft 31 is defined to be 8-12 mm.

These rational numerical choices can make the number of times of pull riveting more rational while taking the comfort of holding into account.

Figure 2:
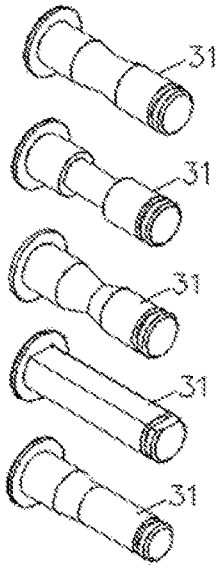
FIG. 2 is a schematic view of multiform space avoidance grooves used by pivoting shafts of a preferred embodiment of the present invention.
Figure 3:
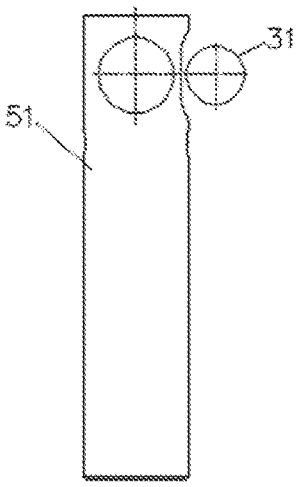
FIG. 3 is a schematic view of a space avoidance groove used by a pulling sleeve of a preferred embodiment of the present invention.
Figure 4:
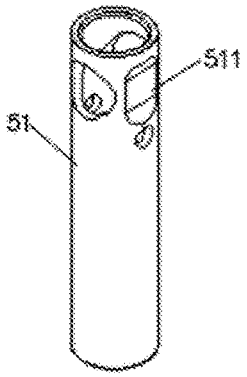
FIG. 4 is a perspective schematic view of a space avoidance groove used by a pulling sleeve of a preferred embodiment of the present invention.

As shown in FIG. 5, the clamping and pulling mechanism further comprises a pulling sleeve 51, wherein the pulling sleeve 51 is connected to the warping end via the connecting shaft 32 and drives the clamping and pulling mechanism to move; and the position where the pulling sleeve 51 is spatially closest to the pivoting shaft 31 is called as an interference area 11. If the warping end is too close to the axis of the pivoting shaft 31, certain difficulty exists in machining, and the pivoting shaft 31 interferes with the pulling sleeve 51 of the clamping and pulling mechanism 5. The larger the axis diameter of the pivoting shaft 31 is, the better the bearing strength and wear resistance is, so it is undesirable to reduce the interference by reducing the axis diameter of the pivoting shaft. As shown in FIG. 1, FIG. 2, FIG. 3 and FIG. 4, in order to solve the interference problem, in some embodiments, at least one of the pulling sleeve 51 or the pivoting shaft 31 is provided with a space avoidance groove within the interference area. As shown in FIG. 1, space avoidance can be achieved by a method of making the middle thinner than two ends for the pivoting shaft 31. As shown in FIG. 2, the pivoting shaft 31 can also use other similar avoidance structures to reduce the impact of interference, and there is no intention to limit the form of the space avoidance groove herein. As shown in FIG. 3 and FIG. 4, the pulling sleeve 51 is additionally provided with a space avoidance groove 511 at the interference area.

In order to reduce interference between the pulling sleeve 51 and the pivoting shaft 31, in some embodiments, the axis diameter of the pivoting shaft 31 is decreased, and meanwhile, in order to achieve the same strength, the pivoting shaft requires a material of higher strength, or a higher heat treatment. Optionally, the original 35 steel is replaced with a high-strength material like 45 steel or 40Cr, and optionally, the original HRC35-40 is replaced with HRC40-50 or a similar higher heat treatment. Meanwhile, similarly, in some other embodiments, the diameter of the pulling sleeve 51 can also be decreased, and the clamping and pulling mechanism matching the pulling sleeve 51 needs to be decreased radially. Similarly, the high-strength material needs to be used for the pulling sleeve 51 and the clamping and pulling mechanism, which undoubtedly increases the cost of the hand riveter.

The line penetrating through the axis of the pivoting shaft 31 and being perpendicular to a moving direction of the clamping and pulling mechanism is an auxiliary line 9, and the auxiliary line 9 is in the same plane as the first handle 1, the second handle 2 and the axis of the pivoting shaft 31. According to the auxiliary line 9 shown in FIG. 6 that penetrates through the axis of the pivoting shaft 31 in a horizontal direction, when the first handle 1 and the second handle 2 are opened to the maximum extent (equivalent to an initial state of pull riveting), the line 12 connecting centers of the connecting shaft 32 and the pivoting shaft 31 forms an included angle a with the auxiliary line 9, and the height in a vertical direction of pull riveting is h1, wherein h1=P* sin a, and P is the distance of the line connecting the centers of the connecting shaft 32 and the pivoting shaft 31.

Figure 6:
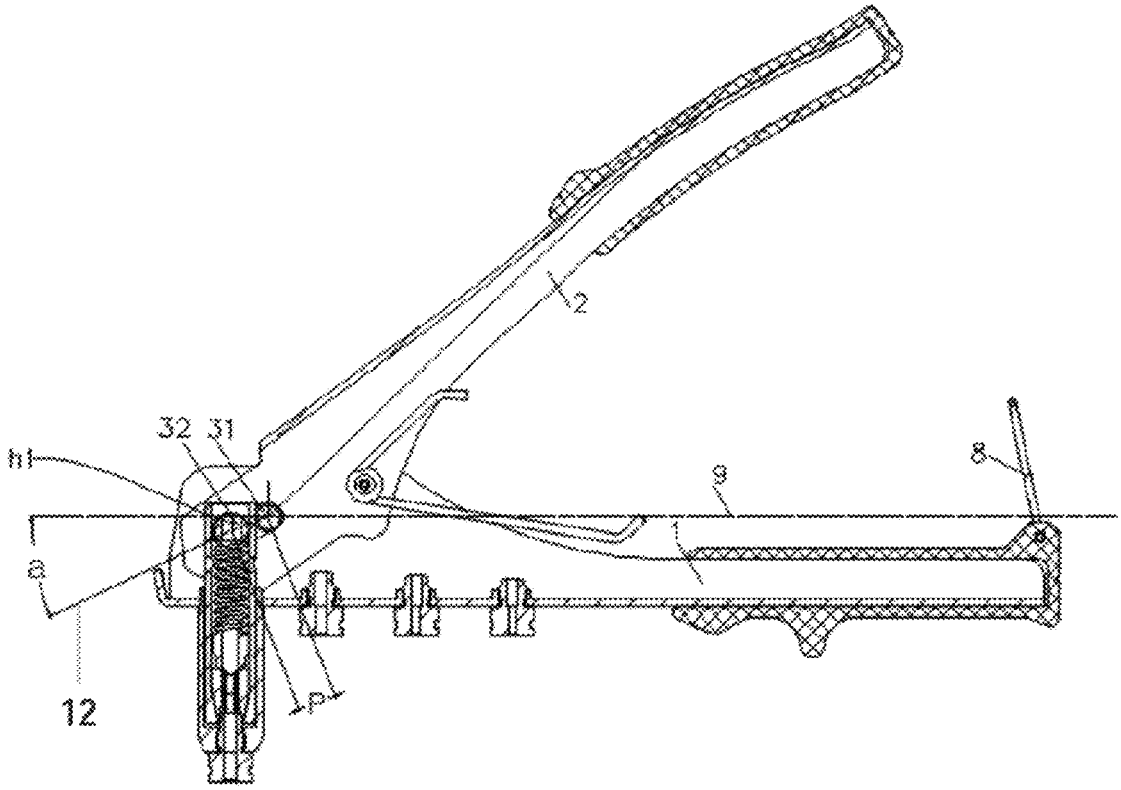
FIG. 6 shows an open state of a first handle and a second handle of a hand riveter of a preferred embodiment of the present invention.
Figure 7:
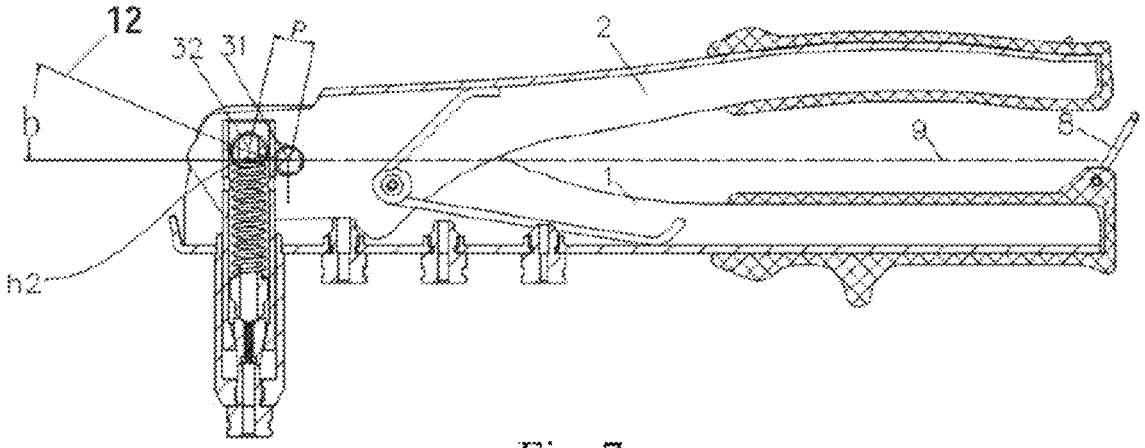
FIG. 7 shows a closed state of a first handle and a second handle of a hand riveter of a preferred embodiment of the present invention.

The second handle shown in FIG. 6 is pressed downwards to the greatest extent to form a final state of pull riveting shown in FIG. 7, the line 12 connecting the centers of the connecting shaft 32 and the pivoting shaft 31 forms an included angle b with the horizontal auxiliary line 9, and the height in the vertical direction of pull riveting is h2, wherein h2=P* sin b, and P is the distance of the line connecting the centers of the connecting shaft 32 and the pivoting shaft 31.

When the included angles a, b are respectively on two sides of the horizontal auxiliary line, the moving distance of pull riveting in the vertical direction is h1+h2=P*(sin a+sin b). When the included angles a, b are respectively on the same side of the horizontal auxiliary line, the moving distance of pull riveting in the vertical direction is an absolute value of the difference between h1 and h2. In some embodiments, under the circumstance that the included angles a, b are respectively on the same side of the horizontal auxiliary line, deflection on one side of the pulling sleeve 51 is large at this time, which is prone to causing the pulling sleeve 51 stuck, and the length of pull riveting is also very short, so in other optimized embodiments, the included angles a, b are respectively on two sides of the horizontal auxiliary line, and more preferably, the included angle a is equal to the included angle b; and when the included angle a is equal to the included angle b, the deflection amount on two sides of the pulling sleeve during pull riveting is small. In some embodiments, the range of the angle value a+b is 20°-60°, wherein the range of the angle a and the angle b is 10°-30° respectively. In some embodiments, the angle value a=b=22°, and the angles a and b are selected such as the hand riveter has an appropriate number of times of pull riveting.

As shown in FIG. 5, the clamping and pulling mechanism further comprises a spring 52, a hollow ejector rod 53 and a separate jaw 54, wherein the spring 52, the hollow ejector rod 53 and the separate jaw 54 are sequentially provided in the pulling sleeve 51 from top to bottom; and inclined faces cooperating with each other are provided on the jaw 54 and the pulling sleeve 51, one end of the spring 52 elastically presses the jaw 54 onto the inclined faces cooperating with each other via the hollow ejector rod 53, and the other end of the spring 52 is connected to the connecting shaft 32. Specifically, a groove is provided on the position where the connecting shaft 32 is in contact with the spring 52, and an end face of the groove is in contact with the other end of the spring 52 and can force the spring 52. The pulling sleeve 51 is provided in the shell 4. The hand riveter further comprises a specification head 6 used for separating the jaw 54.

The specification head 6 is used for separating the jaw 54, and the size of opening of the jaw 54 is adjusted through the length of the specification head 6 extending into the shell 4. Under normal circumstances, in order to work more efficiently, different specifications of rivets correspond to different specification heads. In embodiments of the present invention, only one specification head is used for achieving pull riveting operations of rivets of different specifications. For example, when the specification of the rivet changes from 4.8 to 2.4, the opening of the jaw 54 needs to decrease, which is achieved by reducing the length of the specification head 6 extending into the shell 4 at this time, and meanwhile, a gap between the end face of the specification head 6 and the jaw increases; and after the specification head 6 is moved to a certain distance in the direction of increasing the gap between same and the jaw, the jaw starts to force a 2.4 rivet rod. The distance between the jaw 54 and the end face of the specification head 6 increases, and therefore the rivet rod extending into the jaw 54 becomes shorter, causing an effective contact area between the jaw 54 and the rivet rod extending into the jaw 54 becomes small and even no contact therebetween, and finally the jaw being unable to normally or effectively grasp the rivet 10 and losing the function of pull riveting at this time. To avoid the above situation, the groove is additionally provided on the end face of the specification head 6 of the present invention to adjust the stroke of the rivet 10, enabling rivets 10 of different specifications to freely adjust the length of the rivet 10 extending into the jaw 54.

Figure 11:
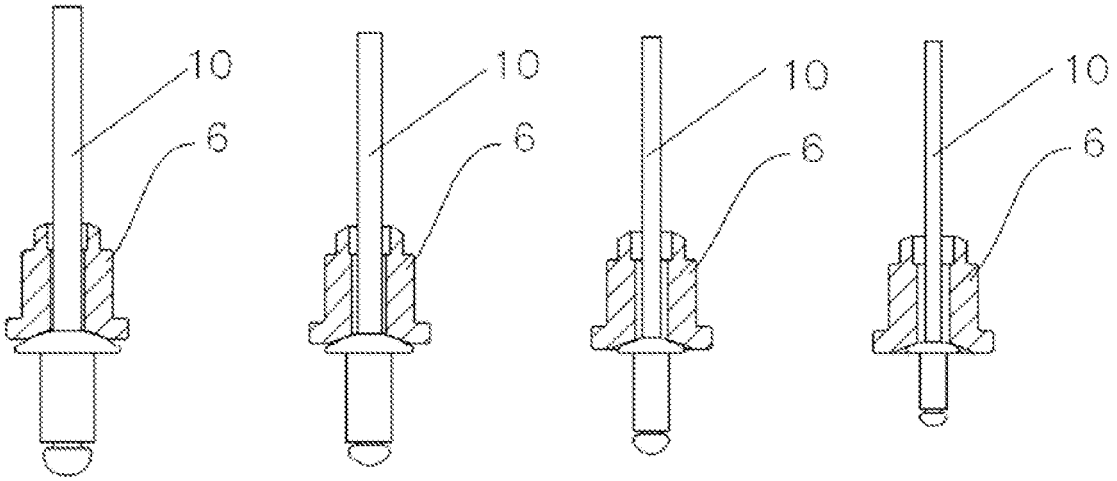
FIG. 11 shows the adaptation of the specification head with the groove provided on the end face thereof to rivets of different specifications.

In embodiments of the present invention, the groove is additionally provided on the end face of the specification head 6 to meet pull riveting requirements of rivets 10 of different specifications; and as shown in FIG. 11, diameters of the rivets 10 from left to right in the figure sequentially decrease, and it can be seen that regardless of the specifications of the rivets, an end face of a cap of the rivet 10 can be well embedded in the groove 61, adjusting the length of the rivet 10 extending into the jaw 54 and further enabling an effective pull riveting operation. One kind of specification head can meet pull riveting requirements of rivets of different specifications, and therefore, the present invention realizes the hand riveter without changing the specification head, making the hand riveter more convenient to use.

The groove of the end face of the specification head 6 should not be too deep, otherwise the cap of the rivet will be embedded too deep in the groove, thereby influencing appearance of the specification head and strength of pull riveting; and meanwhile, the width of the groove should not be too small, otherwise the cap of the rivet of a small specification cannot effectively enter the groove. In some embodiments, the depth of the groove is no more than 2 mm, and the width of the groove is no less than 5 mm.

Figure 10:
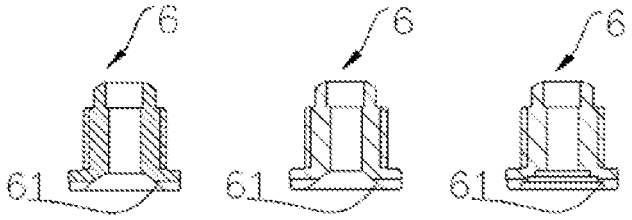
FIG. 10 is a cross-section schematic view of specification heads with multiform grooves being provided on end faces thereof.

As shown in FIG. 8, FIG. 9, FIG. 10 and FIG. 11, the groove is additionally provided on the end face of the specification head 6; and as shown in FIG. 10, the groove 61 can be one of a circular arc groove, a step-shaped groove or a chamfering groove, or of other similar arrangements.

Figure 8:
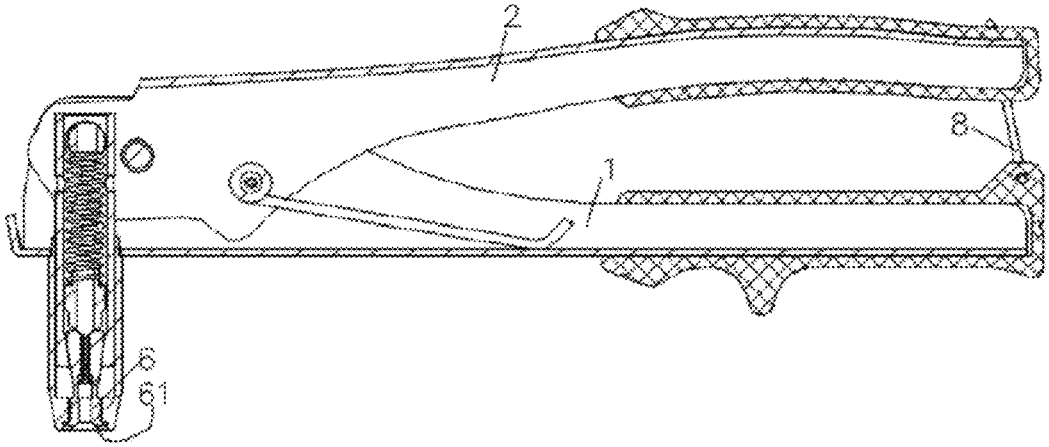
FIG. 8 shows a hand riveter of a further preferred embodiment of the present invention, wherein a groove is provided on an end face of a specification head.
Figure 9:
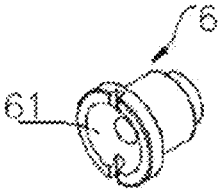
FIG. 9 is a perspective schematic view of the specification head with the groove being provided on the end face thereof.

As shown in FIG. 5, the hand riveter further comprises a torsional spring 7, wherein the torsional spring 7 is fixed by a fixing shaft 33, and the torsional spring 7 is in elastic contact with the first handle and the second handle, respectively; and when the first handle and the second handle are completely opened, elastic force of the torsional spring 7 is fully released. As shown in FIG. 8, the hand riveter further comprises a fixing member 8, and when the hand riveter is in a non-working state, the first handle and the second handle are closed, and the fixing member 8 overcomes the elastic force of the torsional spring 7 to fix the first handle and the second handle.

The specific preferred embodiments of the present invention are described in detail as above. It should be appreciated that a person of ordinary skill in the art would be able to make modifications and variations in accordance with the concept of the present invention without involving any inventive effort. Therefore, any technical solution that can be obtained by a person skilled in the art by means of logical analysis, reasoning or limited trials on the basis of the prior art and according to the concept of the present invention should be included within the scope of protection of the claims.

The invention claimed is:

1. A hand riveter, characterized by comprising a first handle, a second handle, and a clamping and pulling mechanism, wherein the second handle is capable of rotating around a pivoting shaft with respect to the first handle;

the second handle is separated into a force applying end and a warping end by the pivoting shaft, and the warping end and the clamping and pulling mechanism are connected via a connecting shaft;

when the force applying end of the second handle is rotated and opened with respect to the first handle, the warping end of the second handle drives the clamping and pulling mechanism to move in a rivet-driving direction;

when the force applying end of the second handle is rotated and closed with respect to the first handle, the warping end of the second handle drives the clamping and pulling mechanism to move in a rivet-pulling direction; and a relative position between the connecting shaft and the pivoting shaft is provided as:

a first force bearing point is located at an axis of the connecting shaft, a second force bearing point is located on the second handle, and when the first handle and the second handle are closed, a largest grip distance position exists, and a ratio of a distance between the first force bearing point and an axis of the pivoting shaft to a distance between the second force bearing point and the axis of the pivoting shaft is 1:16-1:25;

or a distance between the axis of the connecting shaft and the axis of the pivoting shaft is 8-12 mm;

wherein the clamping and pulling mechanism comprises a pulling sleeve, and the pulling sleeve is connected to the warping end via the connecting shaft and drives the clamping and pulling mechanism to move; and at an interference area, which refers to a position where the pulling sleeve is spatially closest to the pivoting shaft, the pivoting shaft is provided with a space avoidance groove;

wherein a position at which the force applying end of the second handle is maximumly rotated and opened with respect to the first handle is a first position, a position at which the force applying end of the second handle is maximally closed with respect to the first handle is a second position, a line penetrating through the axis of the pivoting shaft and being perpendicular to a moving direction of the clamping and pulling mechanism is an auxiliary line, and the auxiliary line is in the same plane as the first handle, the second handle and the axis of the pivoting shaft; and at the first position, an angle between the auxiliary line and a line connecting centers of the connecting shaft and the pivoting shaft is a first angle, and at the second position, an angle between the auxiliary line and the line connecting the centers of the connecting shaft and the pivoting shaft is a second angle, and the first angle and the second angle are on two sides of the auxiliary line.

2. The hand riveter of claim 1, wherein a position at which the force applying end of the second handle is maximally rotated and opened with respect to the first handle is a first position, a position at which the force applying end of the second handle is maximally closed with respect to the first handle is a second position, and an angle that the second handle rotates from the first position, with respect to the first handle, to the second position is 20°-60°.

3. The hand riveter of claim 1, wherein the first angle is 10°-30°, and the second angle is 10°-30°.

4. The hand riveter of claim 1, wherein the first angle is 22°, and the second angle is 22°.

5. The hand riveter of claim 1, wherein the first angle is equal to the second angle.

6. The hand riveter of claim 1, wherein a material of the pivoting shaft is one of 35 steel, 45 steel or 40Cr.

7. A hand riveter, comprising a first handle, a second handle and a clamping and pulling mechanism, wherein the second handle is capable of rotating around a pivoting shaft with respect to the first handle;

the second handle is separated into a force applying end and a warping end by the pivoting shaft, and the warping end and the clamping and pulling mechanism are connected via a connecting shaft;

when the force applying end of the second handle is rotated and opened with respect to the first handle, the warping end of the second handle drives the clamping and pulling mechanism to move in a rivet-driving direction;

when the force applying end of the second handle is rotated and closed with respect to the first handle, the warping end of the second handle drives the clamping and pulling mechanism to move in a rivet-pulling direction; and the clamping and pulling mechanism comprises a spring, a hollow ejector rod, a separate jaw and a pulling sleeve, wherein the spring, the hollow ejector rod and the separate jaw are sequentially provided in the pulling sleeve from top to bottom; inclined faces cooperating with each other are provided on the jaw and the pulling sleeve, and the spring elastically presses the separate jaw onto the inclined faces cooperating with each other via the hollow ejector rod; and the hand riveter further comprises a specification head used for separating the jaw, wherein an end face of the specification head is provided with a groove, the depth of the groove is no more than 2 mm, and the width of the groove is no less than 5 mm;

wherein the clamping and pulling mechanism comprises a pulling sleeve, and the pulling sleeve is connected to the warping end via the connecting shaft and drives the clamping and pulling mechanism to move; and at an interference area, which refers to a position where the pulling sleeve is spatially closest to the pivoting shaft, the pivoting shaft is provided with a space avoidance groove;

wherein a position at which the force applying end of the second handle is maximumly rotated and opened with respect to the first handle is a first position, a position at which the force applying end of the second handle is maximally closed with respect to the first handle is a second position, a line penetrating through the axis of the pivoting shaft and being perpendicular to a moving direction of the clamping and pulling mechanism is an auxiliary line, and the auxiliary line is in the same plane as the first handle, the second handle and the axis of the pivoting shaft; and at the first position, an angle between the auxiliary line and a line connecting centers of the connecting shaft and the pivoting shaft is a first angle, and at the second position, an angle between the auxiliary line and the line connecting the centers of the connecting shaft and the pivoting shaft is a second angle, and the first angle and the second angle are on two sides of the auxiliary line.

8. The hand riveter of claim 7, wherein the groove is one of a circular arc groove, a step-shaped groove or a chamfering groove.

* * * * *